US010465432B1

(12) United States Patent
Brannon

(10) Patent No.: US 10,465,432 B1
(45) Date of Patent: Nov. 5, 2019

(54) FRAME ASSEMBLY WITH SHIM JACK

(71) Applicant: Sympateco, Inc., Omaha, NE (US)

(72) Inventor: Curt Brannon, Omaha, NE (US)

(73) Assignee: Sympateco, Inc., Omaha, NE (US)

( * ) Notice: Subject to any disclaimer, the term of this patent is extended or adjusted under 35 U.S.C. 154(b) by 0 days.

(21) Appl. No.: 15/825,863

(22) Filed: Nov. 29, 2017

Related U.S. Application Data

(60) Provisional application No. 62/543,682, filed on Aug. 10, 2017, provisional application No. 62/427,368, filed on Nov. 29, 2016.

(51) Int. Cl.
*E06B 1/60* (2006.01)
*E06B 1/12* (2006.01)

(52) U.S. Cl.
CPC ..... *E06B 1/6076* (2013.01); *E06B 1/12* (2013.01)

(58) Field of Classification Search
CPC ..... F16B 5/0233; E06B 1/12; E06B 1/6076
USPC ..... 52/126.1; 411/393
See application file for complete search history.

(56) References Cited

U.S. PATENT DOCUMENTS 2,136,592 A * 11/1938 Mayer ..... B23B 27/16 407/108
2,595,506 A * 5/1952 Backman ..... E06B 1/18 16/246
2,835,933 A * 5/1958 Evans ..... E06B 1/52 52/211
3,054,321 A * 9/1962 Macchia ..... H01R 35/02 403/56
3,224,152 A * 12/1965 Evans ..... E06B 1/52 49/505
3,469,360 A * 9/1969 Carlson ..... E06B 1/6076 248/188.4
3,570,203 A * 3/1971 Williams ..... E06B 1/6076 52/217
3,618,994 A * 11/1971 Gepfert ..... F16B 39/02 403/103
3,721,055 A * 3/1973 Jerchower ..... E06B 1/12 49/504
4,300,793 A 11/1981 Benzel, Jr.
(Continued)

FOREIGN PATENT DOCUMENTS

EP 1984179 A2 10/2008
EP 2710213 A1 3/2014
(Continued)

*Primary Examiner* — Paola Agudelo
(74) *Attorney, Agent, or Firm* — Ryan T. Grace; Advent, LLP

(57) ABSTRACT

Aspects of the disclosure relate to a frame assembly, such as a door frame assembly for hanging a door. A frame assembly can include a longitudinal adjustment mechanism and a shim jack for connecting to the adjustment mechanism. The shim jack can include a longitudinal body with a first leg and a second leg extending from a base of the longitudinal body. The frame assembly can also include a frame with a jamb leg for adjustably connecting to the adjustment mechanism. The jamb leg can define a port for receiving the shim jack, and the adjustment mechanism may be operable to move the base of the shim jack with respect to the jamb leg to brace the frame assembly within an opening, e.g., by moving the first leg and the second leg against a framing member that defines the opening.

16 Claims, 9 Drawing Sheets

(56) References Cited

U.S. PATENT DOCUMENTS

| | | | | |
|---|---|---|---|---|
| 4,437,784 | A * | 3/1984 | Peterson | E04F 13/0853 29/432.2 |
| 4,492,500 | A * | 1/1985 | Ewing | F16B 31/021 411/393 |
| 4,731,965 | A | 3/1988 | Jensen | |
| 4,873,804 | A * | 10/1989 | Kukke | E06B 1/6076 52/217 |
| 4,927,305 | A * | 5/1990 | Peterson, Jr. | F16B 31/025 403/16 |
| 4,940,259 | A * | 7/1990 | Williams | F16L 23/024 285/3 |
| 5,655,343 | A | 8/1997 | Seals | |
| 6,018,916 | A | 2/2000 | Henry | |
| 6,691,461 | B1 | 2/2004 | Gitkin | |
| 7,784,734 | B2 * | 8/2010 | Christman | B64C 25/16 244/102 R |
| 7,987,637 | B2 | 8/2011 | Smith | |
| 8,813,437 | B1 | 8/2014 | Spofford | |
| 9,163,854 | B2 | 10/2015 | Arbucci | |
| 9,194,170 | B2 | 11/2015 | Eis et al. | |
| 2001/0023557 | A1 * | 9/2001 | Graham | E06B 1/10 49/504 |
| 2006/0213135 | A1 | 9/2006 | Mathes | |
| 2007/0166498 | A1 | 7/2007 | Penar | |
| 2008/0075556 | A1 | 3/2008 | Smith | |
| 2009/0127369 | A1 | 5/2009 | Mullet et al. | |
| 2010/0072763 | A1 | 3/2010 | Allen | |
| 2014/0109487 | A1 | 4/2014 | Daoust | |
| 2015/0097096 | A1 | 4/2015 | Arbucci | |
| 2015/0368948 | A1 * | 12/2015 | Ward | E05D 7/043 411/366.1 |

FOREIGN PATENT DOCUMENTS

| | | | |
|---|---|---|---|
| WO | 2002090702 | A1 | 11/2002 |
| WO | 2007082008 | A2 | 7/2007 |
| WO | 20122155908 | A1 | 11/2012 |
| WO | 2014186104 | A1 | 11/2014 |

* cited by examiner

FRAME ASSEMBLY WITH SHIM JACK

CROSS-REFERENCE TO RELATED APPLICATIONS

The present application claims the benefit under 35 U.S.C. § 119(e) of U.S. Provisional Application Ser. No. 62/427,368, filed Nov. 29, 2016, and titled "FRAME ASSEMBLY WITH SHIM JACK" and U.S. Provisional Application Ser. No. 62/543,682, filed Aug. 10, 2017, and titled "FRAME ASSEMBLY WITH SHIM JACK," which are herein incorporated by reference in their entireties.

DRAWINGS

The Detailed Description is described with reference to the accompanying figures.

DETAILED DESCRIPTION

Figure 1:
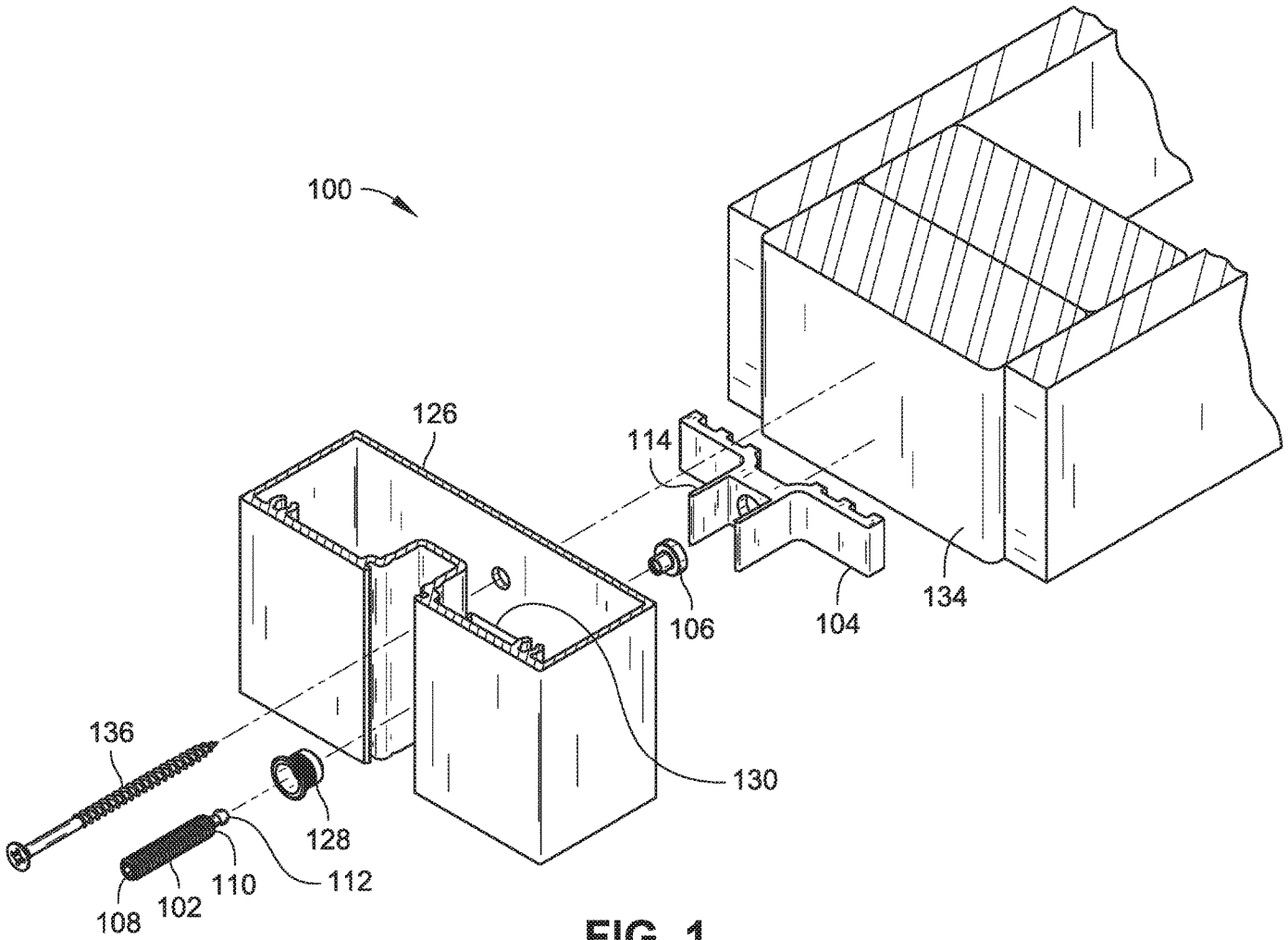
FIG. 1 is a partial cross-sectional isometric view illustrating a door frame assembly including a frame with a jamb leg and a shim jack, where the shim jack can be adjusted with respect to the jamb leg to brace the door frame assembly against the framing in a door opening in accordance with example embodiments of the present disclosure.
Figure 2:
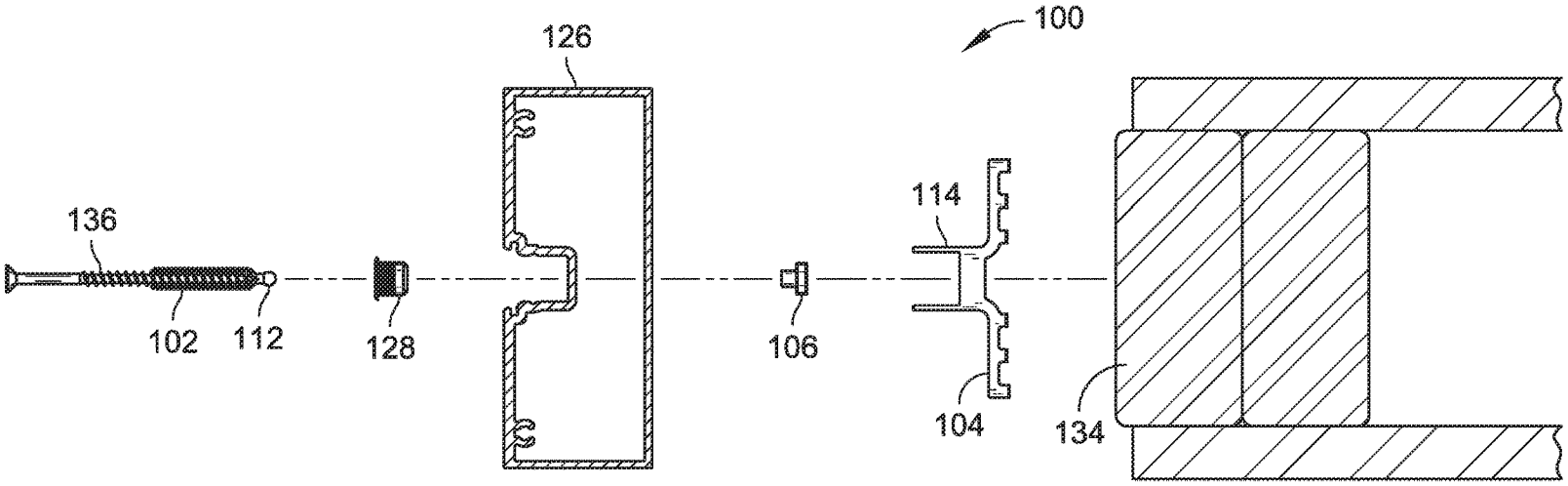
FIG. 2 is a partial exploded top plan view of the door frame assembly illustrated in FIG. 1.
Figure 3:
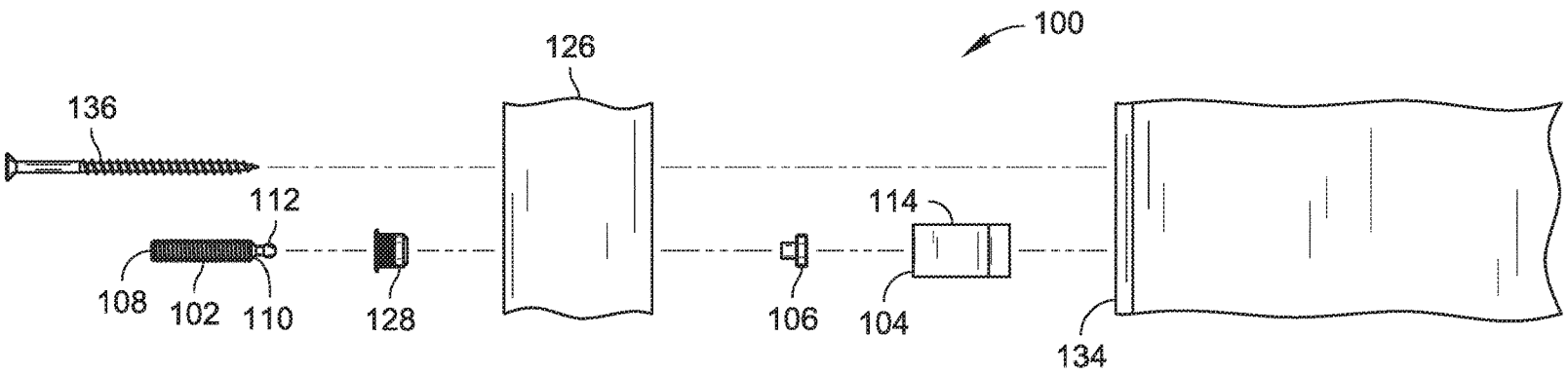
FIG. 3 is a partial exploded side elevation view of the door frame assembly illustrated in FIG. 1.
Figure 4:
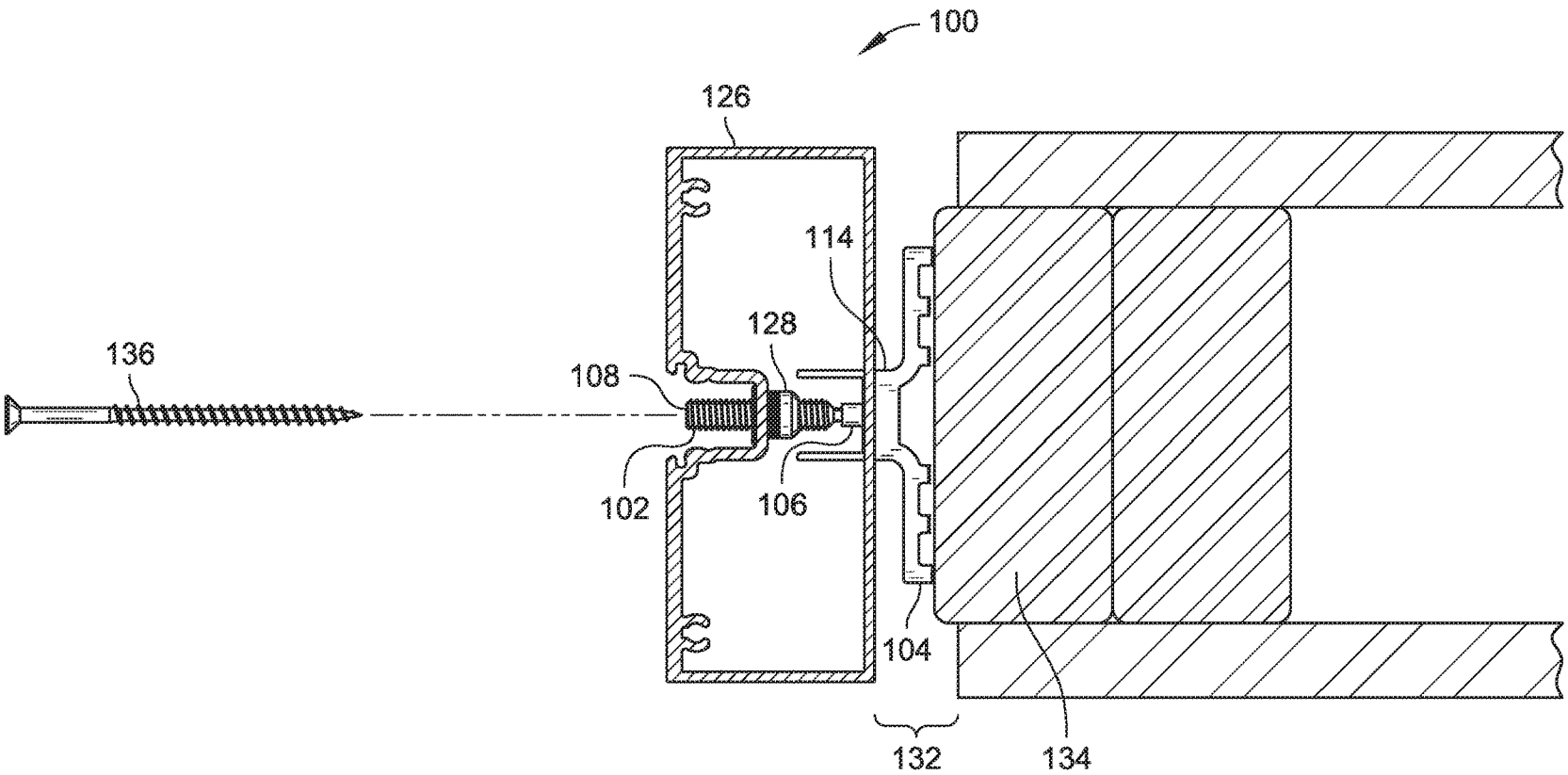
FIG. 4 is a top plan view of the door frame assembly illustrated in FIG. 1, where the jamb leg is adjusted toward the framing of the door opening.
Figure 5:
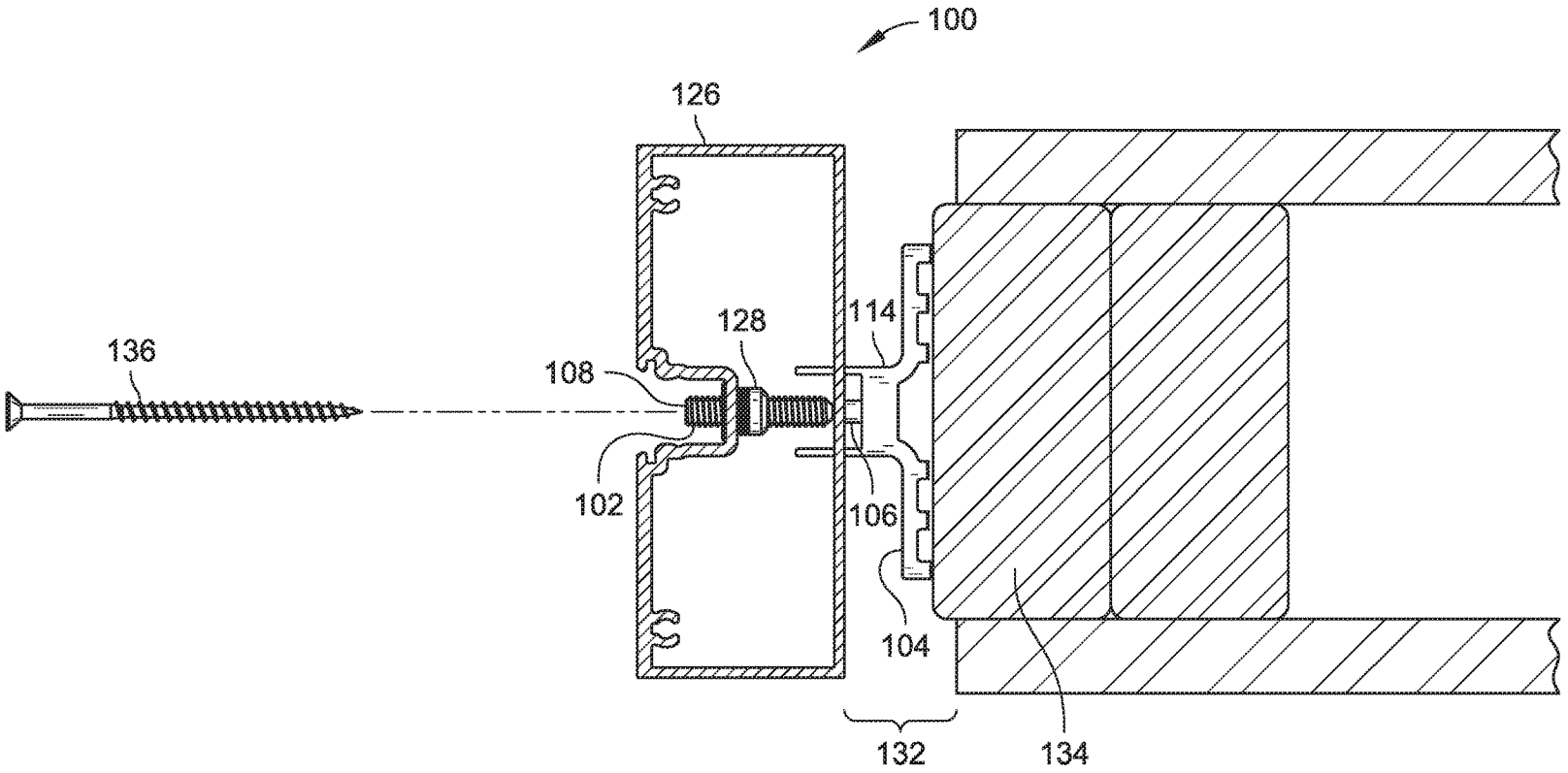
FIG. 5 is a top plan view of the door frame assembly illustrated in FIG. 1, where the jamb leg is adjusted away from the framing of the door opening.
Figure 6:
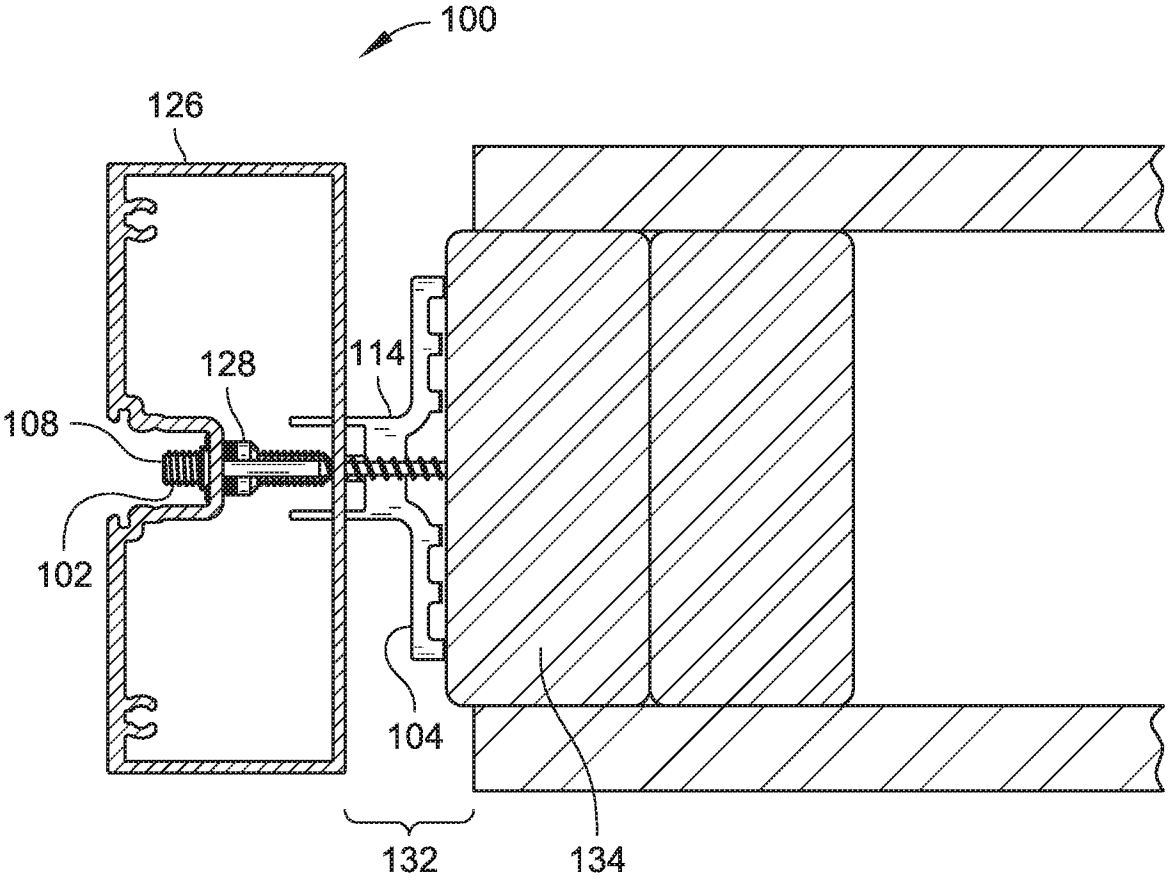
FIG. 6 is a top plan view of the door frame assembly illustrated in FIG. 1, where the jamb leg is secured to the framing of the door opening by a screw.
Figure 7:
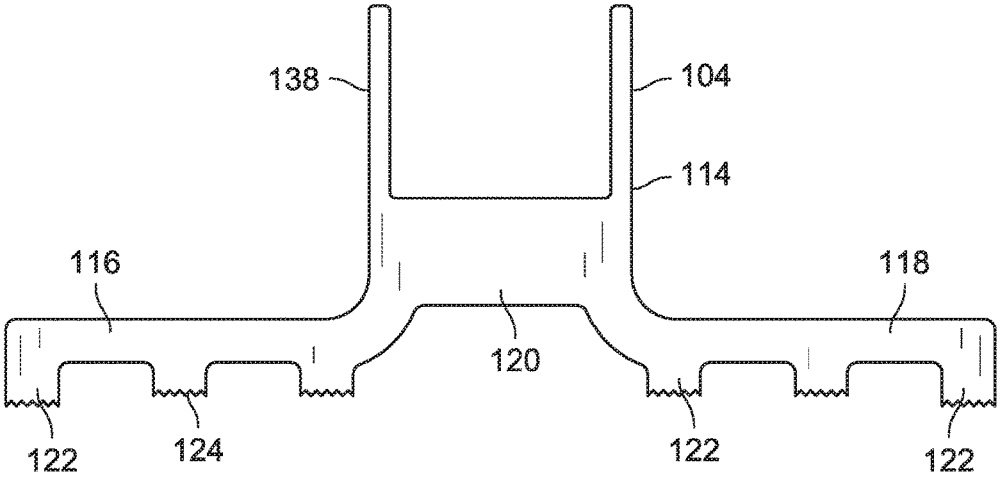
FIG. 7 is a top view of a shim jack for a door frame assembly, such as the door frame assembly illustrated in FIG. 1, where feet of the shim jack include surface features in accordance with example embodiments of the present disclosure.
Figure 8:
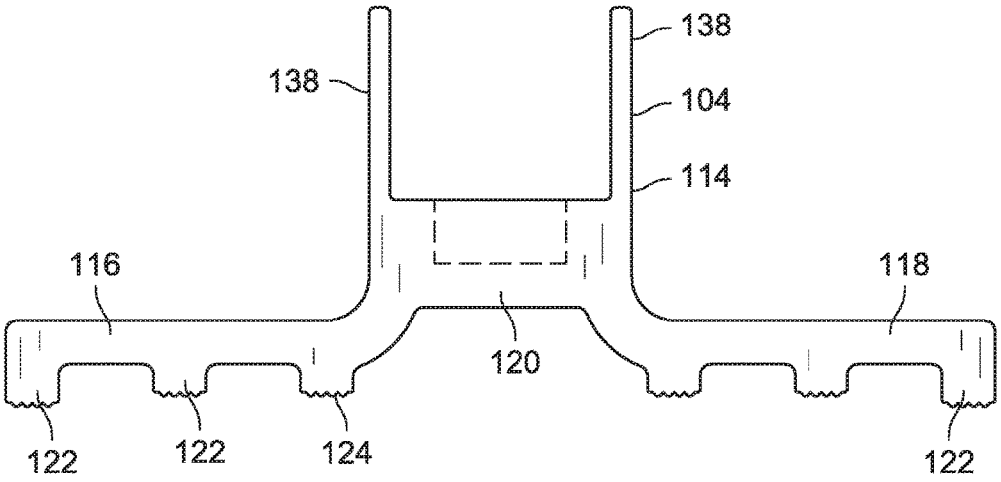
FIG. 8 is a top view of a shim jack for a door frame assembly, such as the door frame assembly illustrated in FIG. 1, where feet of the shim jack include other surface features in accordance with example embodiments of the present disclosure.
Figure 9:
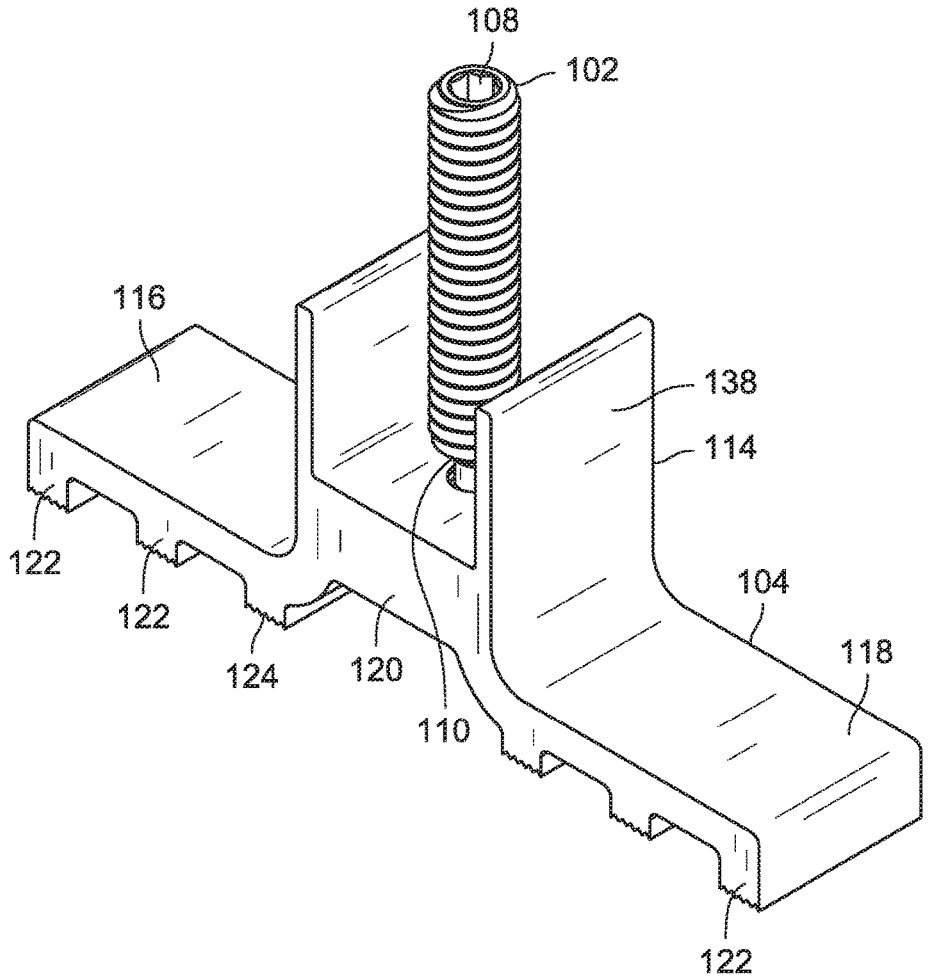
FIG. 9 is a front, isometric view of a second shim jack and longitudinal adjustment mechanism combination for a door frame assembly, such as the door frame assembly illustrated in FIG. 1, in accordance with example embodiments of the present disclosure.
Figure 10:
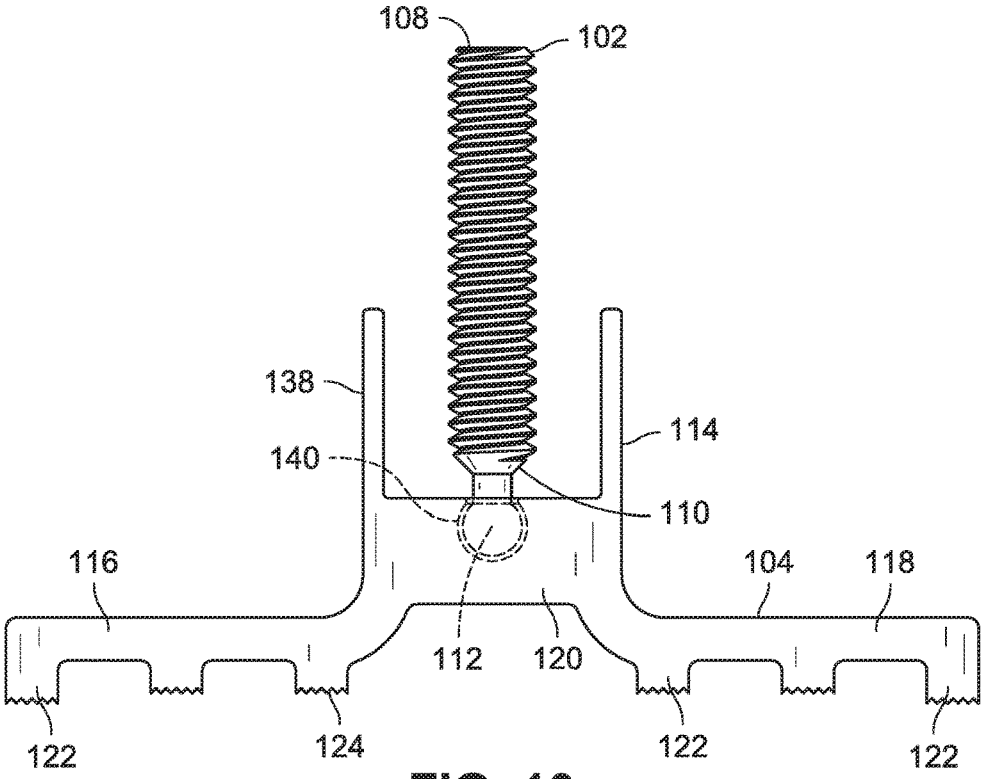
FIG. 10 is a front view of the second shim jack and longitudinal adjustment mechanism combination illustrated in FIG. 9.
Figure 11:
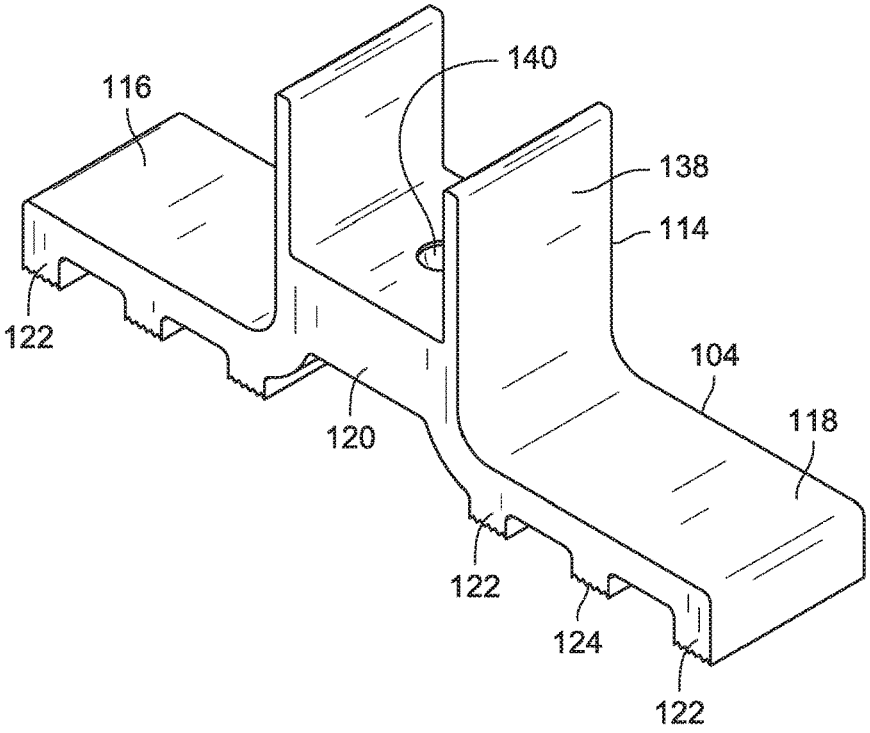
FIG. 11 is a front, isometric view of the second shim jack illustrated in FIG. 9.
Figure 12:
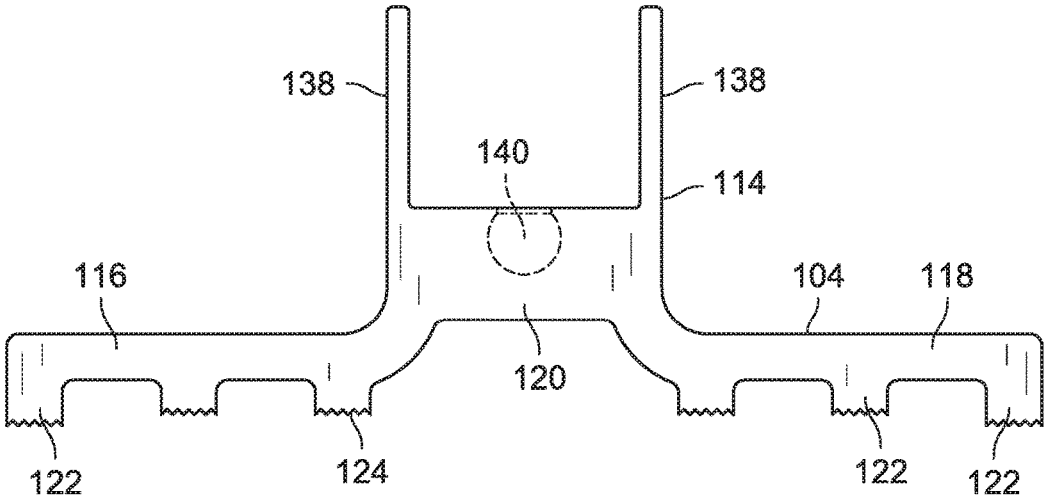
FIG. 12 is front view of the second shim jack illustrated in FIG. 11.
Figure 13:
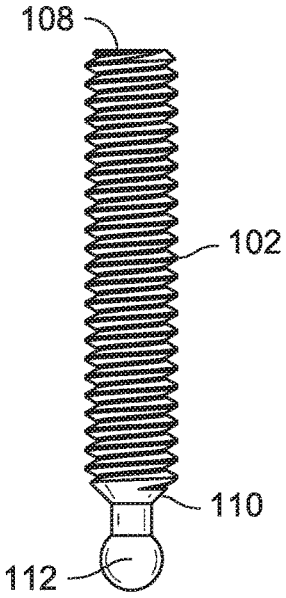
FIG. 13 is front view of the longitudinal adjustment mechanism (e.g., adjustment screw) illustrated in FIG. 9.

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. The following detailed description is, therefore, not to be taken in a limiting sense.

Referring generally to FIG. 1 through 13, frame assemblies 100 are described. A frame assembly 100 can include a longitudinal adjustment mechanism (e.g., an adjustment screw 102). The frame assembly 100 can also include a shim jack 104 for connecting to the adjustment screw 102. For example, the shim jack 104 can include an attachment, such as a socket attachment 106, for receiving the adjustment screw 102. In some embodiments, one end 108 of the adjustment screw 102 includes a head and/or an opening, such as a socket, for receiving a driving instrument, such as the shaft of a screwdriver or a hexagonal wrench, while the other end 110 is configured for attachment to the socket attachment 106 of the shim jack 104. For instance, the adjustment screw 102 includes a ball connector 112 at its end, which can connect to the socket attachment 106 on the shim jack 104.

In embodiments of the disclosure, the shim jack 104 may include a longitudinal body 114 with at least a first leg 116 and a second leg 118 extending from a base 120 of the longitudinal body 114 (and possibly a third leg, a fourth leg, and so forth). In some embodiments, the first leg 116 and/or the second leg 118 can include one or more feet 122. For example, three (3) feet 122 may be included on the first leg 116, and three (3) feet 122 may also be included on the second leg 118. However, it should be noted that this number of feet 122 is provided by way of example and is not meant to limit the present disclosure. In other embodiments, more or fewer than three (3) feet 122 may be included on the first leg 116 and/or the second leg 118 of the longitudinal body 114 (e.g., two (2) feet, four (4) feet, etc.). Further, one or more of the feet 122 may include various surface features 124 for gripping. For example, a foot 122 can include a rough surface and/or a number of small protrusions (e.g., ridges, spikes, etc.).

The frame assembly 100 can also include a jamb leg 126, and the adjustment screw 102 can be adjustably connected to the jamb leg 126. For example, the jamb leg 126 can include another attachment, such as a rib nut 128 or another threaded connector, for receiving the adjustment screw 102. However, the rib nut 128 is provided by way of example and is not meant to limit the present disclosure. In other embodiments, different attachments configured to interface with an adjustment mechanism, including other threaded inserts can be used. Further, the jamb leg 126 itself may include integral threading and/or other features to accommodate adjustment of an adjustment mechanism, such as the adjustment screw 102. The jamb leg 126 can define a port 130 for receiving the shim jack 104. For example, the longitudinal body 114 of the shim jack 104 can have a generally rectangular cross-section, and the jamb leg 126 can define a similarly-shaped, generally rectangular opening port 130, such that the orientation of the shim jack 104 can be maintained as the shim jack 104 is moved with respect to the jamb leg 126. In embodiments of the disclosure, the adjustment screw 102 is operable to move the base 120 of the shim jack 104 with respect to the jamb leg 126 to brace the frame assembly 100 within an opening 132 by moving the first leg 116 and the second leg 118 against a framing member 134 (e.g., a stud) that defines the opening 132.

In some embodiments, the frame assembly 100 is configured for hanging a door. For instance, the frame assembly 100 can be a door frame assembly that includes two opposing side jamb legs 126, one on each side of the door, and a header jamb leg 126 spanning between the two side jamb legs 126. In this manner, the three jamb legs 126 form a frame for the frame assembly 100. One or more of these jamb legs 126 can each be connected to one or more shim jacks 104 (e.g., as previously described). Then, the shim jacks 104 can be used in the shim space between the frame assembly 100 and the framing to brace the door frame assembly against the framing, e.g., by moving the shim jacks 104 in the shim space between the door frame and the framing. For example, each adjustment screw 102 can be turned to push its associated jamb leg 126 out against the rough opening 132 for the door, screw points can be located, and then the door frame can be secured to the framing (e.g., using screws 136) once the placement of the door frame has been set using the adjustable shim jacks 104. For example, each jamb leg 126 can include holes for receiving screws 136 to secure the jamb leg 126 to framing studs and/or a header. In some embodiments, the header jamb leg 126 can be arched. It should be noted that a door frame assembly 100 is provided by way of example and is not meant to limit the present disclosure. In other embodiments, frame assemblies 100 described herein can be used in other frame applications, including, but not necessarily limited to window frames and so forth.

FIGS. 9 through 13 illustrate a second shim jack 104 and longitudinal adjustment mechanism combination for a door frame assembly 100, such as the door frame assembly 100 illustrated in FIG. 1, in accordance with example embodiments of the present disclosure. The second shim jack 104 and longitudinal adjustment mechanism combination is similar to that shown with respect to FIGS. 1 through 8 except for those features described hereinbelow. The second shim jack 104 may include a longitudinal body 114 (e.g., including at least a pair of body side walls 138 and a body base 120) with at least a first leg 116 and a second leg 118 extending from the base 120 of the longitudinal body 114 (and possibly a third leg, a fourth leg, and so forth). Further, one or more of the feet 122 may include various surface features 124 for gripping. The body base 120 of the longitudinal body 114 of the second shim jack 104 can define a ball socket 140 therein. The longitudinal adjustment mechanism may be in the form of an adjustment screw 102, with one end of the adjustment screw 102 includes a head and/or an opening 132, such as a socket, for receiving a driving instrument, such as the shaft of a screwdriver or a hexagonal wrench, while the other end is configured for insertion into and attachment within the ball socket 140 of the body base 120 associated with the second shim jack 104. In some embodiments, the adjustment screw 102 mechanism may be configured to receive a further screw element (e.g., by being provided with interior screw-threading) therein, e.g., to provide for additional effective length. For instance, the adjustment screw 102 can include a ball connector 112 at one end, which can connect to the ball socket 140 in the body base 120. The ball connector 112 end and the ball socket 140 may be sized relative to one another so as to enable a desired range (e.g., angular motion) and level of ease (e.g., amount of clearance/friction) of pivotable movement therebetween. As such, the second shim jack 104 and adjustment screw 102 mechanism combination can facilitate a direct ball-joint connection between those two elements, unlike the combination shown in FIGS. 1 through 8, in which the separate socket attachment 106 can be incorporated.

In some embodiments, the insertion of the ball connector 112 end of the adjustment screw 102 into the ball socket 140 of the body base 120 may be achieved, for example, via a snap fit or a force fit. To accommodate the insertion of the ball connector 112 end thereinto, the body base 120, at least, of the second shim jack 104 may be formed of a resilient material, such as aluminum, spring steel, plastic, or any other material that is both pliable enough to facilitate the insertion of the ball connector 112 into the ball socket 140 in the body base 120, yet rigid and strong enough to ensure the retention of the ball connector 112 upon insertion thereinto. Of course, the entire shim jack 104 may be made of the same resilient material chosen for the body base 120.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A frame assembly comprising:

an adjustment screw comprising a ball connector end and a driving end;

a shim jack for connecting to the adjustment screw, the shim jack including a longitudinal body with a first leg and a second leg extending from a base of the longitudinal body, the longitudinal body of the shim jack defining a ball socket therein for receiving the ball connector end of the adjustment screw, wherein the ball connector and the ball socket are sized to enable a desired range of motion and amount of friction in pivotable movement between the ball connector and the ball socket, and wherein the ball connector is inserted into the ball socket via a snap fit; and a frame including a jamb leg for adjustably connecting the adjustment screw, the jamb leg defining a port for receiving the shim jack, wherein the adjustment screw is operable to move the base of the shim jack with respect to the jamb leg to brace the frame assembly within an opening by moving the first leg and the second leg against a framing member that defines the opening, and wherein the jamb leg includes a rib nut for receiving the adjustment screw.

2. The frame assembly as recited in claim 1, wherein each one of the first leg and the second leg includes at least one foot.

3. The frame assembly as recited in claim 2, wherein the feet each include at least one surface feature for gripping the framing member.

4. The frame assembly as recited in claim 1, wherein the frame is configured for hanging a door.

5. A frame assembly comprising:

an adjustment screw comprising a ball connector end and a driving end;

a shim jack for connecting to the adjustment screw, the shim jack including a longitudinal body with a first leg and a second leg extending from a base of the longitudinal body and a ball socket for receiving the ball connector end of the adjustment screw, wherein the ball connector and the ball socket are sized to enable a desired range of motion and amount of friction in pivotable movement between the ball connector and the ball socket, and wherein the ball connector is inserted into the ball socket via a snap fit; and a frame including a jamb leg for adjustably connecting the adjustment screw, the jamb leg defining a port for receiving the shim jack, wherein the adjustment screw is operable to move the base of the shim jack with respect to the jamb leg to brace the frame assembly within an opening by moving the first leg and the second leg against a framing member that defines the opening, and wherein the jamb leg includes a rib nut for receiving the adjustment screw.

6. The frame assembly as recited in claim 5, wherein the longitudinal body of the shim jack includes an attachment comprising the ball socket for receiving the ball connector end of the adjustment screw.

7. The frame assembly as recited in claim 5, wherein each one of the first leg and the second leg includes at least one foot.

8. The frame assembly as recited in claim 7, wherein the feet each include at least one surface feature for gripping the framing member.

9. The frame assembly as recited in claim 5, wherein the longitudinal body of the shim jack defines the ball socket therein.

10. The frame assembly as recited in claim 5, wherein the frame is configured for hanging a door.

11. A frame assembly comprising:

a longitudinal adjustment mechanism;

a shim jack for connecting to the longitudinal adjustment mechanism, the shim jack including a longitudinal body with a first leg and a second leg extending from a base of the longitudinal body, wherein the longitudinal body has a generally rectangular cross-section, the longitudinal body of the shim jack includes an attachment for receiving the longitudinal adjustment mechanism; and a frame including a jamb leg for adjustably connecting the longitudinal adjustment mechanism, the jamb leg defining a generally rectangular port for receiving the shim jack, wherein the longitudinal adjustment mechanism is operable to move the base of the shim jack with respect to the jamb leg to brace the frame assembly within an opening by moving the first leg and the second leg against a framing member that defines the opening, and wherein the jamb leg includes a rib nut for receiving the adjustment screw.

12. The frame assembly as recited in claim 11, wherein the longitudinal adjustment mechanism comprises an adjustment screw.

13. The frame assembly as recited in claim 11, wherein each one of the first leg and the second leg includes at least one foot.

14. The frame assembly as recited in claim 13, wherein the feet each include at least one surface feature for gripping the framing member.

15. The frame assembly as recited in claim 11, wherein the frame is configured for hanging a door.

16. A frame assembly comprising:

a longitudinal adjustment mechanism comprising a ball connector end;

a shim jack for connecting to the longitudinal adjustment mechanism, the shim jack including a longitudinal body with a first leg and a second leg extending from a base of the longitudinal body, wherein the longitudinal body has a generally rectangular cross-section, the longitudinal body of the shim jack defining a ball socket therein, the ball connector end being received in the ball socket within the longitudinal body of the shim jack; and a frame including a jamb leg for adjustably connecting the longitudinal adjustment mechanism, the jamb leg defining a generally rectangular port for receiving the shim jack, wherein the longitudinal adjustment mechanism is operable to move the base of the shim jack with respect to the jamb leg to brace the frame assembly within an opening by moving the first leg and the second leg against a framing member that defines the opening, and wherein the jamb leg includes a rib nut for receiving the adjustment screw.

* * * * *